US006666809B1

(12) United States Patent
John

(10) Patent No.: US 6,666,809 B1
(45) Date of Patent: Dec. 23, 2003

(54) PAPER DECURLER FOR UNEVEN CURL PROFILE

(75) Inventor: Koch H. John, Wisconsin Rapids, WI (US)

(73) Assignee: Stora Enso North America Corp., Wisconsin Rapids, WI (US)

( * ) Notice: Subject to any disclaimer, the term of this patent is extended or adjusted under 35 U.S.C. 154(b) by 0 days.

(21) Appl. No.: 09/494,673

(22) Filed: Jan. 31, 2000

(51) Int. Cl.[7] ..... B31F 1/00

(52) U.S. Cl. ..... 493/461; 493/459; 493/957; 493/958

(58) Field of Search ..... 493/459, 460, 493/461, 957, 958

(56) References Cited

U.S. PATENT DOCUMENTS

| | | | | | |
|---|---|---|---|---|---|
| 3,661,703 | A | * | 5/1972 | Shelor | 162/270 |
| 3,879,817 | A | | 4/1975 | Becker | |
| 3,912,188 | A | | 10/1975 | Ballard | |
| 3,971,696 | A | * | 7/1976 | Manfredi | 162/271 |
| 4,135,962 | A | * | 1/1979 | Sinclair et al. | 101/23 |
| 4,217,682 | A | | 8/1980 | Young, Jr. et al. | |
| 4,300,891 | A | * | 11/1981 | Bemiss | 162/271 |
| 4,322,802 | A | | 3/1982 | Lewis, Jr. et al. | |
| 4,360,356 | A | | 11/1982 | Hall | |
| 4,578,845 | A | | 4/1986 | Young, Jr. | |
| 4,829,918 | A | | 5/1989 | Young, Jr. | |
| 5,009,749 | A | | 4/1991 | Cederholm et al. | |
| 5,141,484 | A | | 8/1992 | Akira | |
| 5,221,950 | A | | 6/1993 | Ford et al. | |
| 5,269,743 | A | * | 12/1993 | Sakuma | 162/271 |
| 5,522,785 | A | | 6/1996 | Kedl et al. | |
| 5,539,511 | A | * | 7/1996 | Wenthe, Jr. et al. | 162/270 |
| 5,611,859 | A | * | 3/1997 | Nielsen et al. | 118/410 |
| 5,637,070 | A | * | 6/1997 | Sasai | 162/271 |
| 5,840,150 | A | * | 11/1998 | Brown | 156/324 |
| 6,273,313 | B1 | * | 8/2001 | Noll et al. | 226/30 |

OTHER PUBLICATIONS

The Mount Hope Roll Book.
Other Loose Pages pertaining to "What is a Mount Hope Roll"?.

* cited by examiner

*Primary Examiner*—Eugene Kim
*Assistant Examiner*—Christopher Harmon
(74) *Attorney, Agent, or Firm*—Pyle & Piontek

(57) ABSTRACT

A method and apparatus are disclosed for reducing or eliminating the precurl in a web of paper. The apparatus includes a decurler which may operate in conjunction with a lead in roll and a bowed roll. Motions are provided to the lead in roll and decurler so that the wrap of the web on the bowed roll remains essentially unaffected by the movement of the decurler into and out of the web. One of the above apparatus or a lead out roll may be skewed to address uneven cross machine curl profile, while the bowed roll addresses baggyness and the decurler, of course curl.

10 Claims, 10 Drawing Sheets

PAPER DECURLER FOR UNEVEN CURL PROFILE

This invention relates to paper webs and more particularly for a method and apparatus for decurling paper or paper board webs prior to the webs being utilized in some other downstream process.

BACKGROUND OF THE INVENTION

In the process of making paper (cardboard or a similar product is in this application also considered defined as "paper") on a papermachine and/or coating paper forces and temperature gradients within the paper can cause it to curl to one side or the other of the web. Curl is normally the result of stresses unequally applied to the paper, say as by winding a web of paper into a roll, causing strains which become set into the rolled paper and when released, as when the roll is unwound, can cause a web or the subsequently cut sheet to curl. For example, running the web over dryer "cans" (rolls), causes the paper to take on the curve of the roll; wetting one side of a web as is done during applying coating to one side can also induce a curl, in a subsequently dried web. Even more frequent is the tendency to induce curl when winding a web onto a roll core when the paper is produced. Then there is a "roll set" curl when the roll is unwound and cut into sheets. While curl is less undesirable in some operations, where the web remains intact, curl is of a greater concern if the web is to be subsequently cut into sheets. Many of today's subsequent paper converting operations, such as forming sheets from a web, and the use of these sheets, as in printing presses and numerous office products, like photocopy machines, facsimile machines and office printers, are sensitive to curl. With too much curl, the cut or formed sheet of paper will have difficulty feeding properly in such uses. It is therefore desirable to limit or eliminate curl while the paper is in web form, before it is subsequently cut into sheets. Various attempts in the past have been made to limit or eliminate curl.

It is conventional to employ web decurlers in various paper converting operations, such as in a sheeter (a machine that converts a roll into cut sheets). These prior art decurlers were usually configured to provide a decurling action by running the web of paper over a small radius decurler, such as a small diameter roll or a non-rotating stationary bar with its edge machined into a small radius. The web is usually carried on the upstream and downstream side of the decurler bar or roll by rotating, cylindrical web supporting rolls. The amount of decurling affected is partly determined by the depth the web is deflected from its initial position on the web support rolls and/or wrap angle of the web around the decurling radius. In this respect the decurler bar or roll operates in a similar manner as a table edge, wherein a tensioned sheet of paper is drawn across the table edge to remove or induce curl. While it is clear why curl would be removed on a sheet, sometimes it is helpful to induce a curl to solve runability problems. The conventional, prior art decurler is effective if the web has an even "cross directional curl," that is the curl is uniform in a direction running across the web. This type curl is referred to as an "even" cross directional curl profile. That is, the tendency of the paper to curl is uniform across the width of the web. However, some webs have curl profiles that can be asymmetrical or non-uniform. Such non-uniform curl can be caused by various factors such as web caliper differences which need not be addressed here. When the web has less than ideal cross direction curl profile, an uneven decurling effect can be created across the width of the web because of unequal tension of the web when traveling around the radius of the decurler bar or roll. An uneven cross directional curl profile can cause one side of the web, its center or combinations of both to receive more or less decurling effect than the rest of the web. This effect is dependent of course on the location of the tight and/or loose areas of the web. Typically, one side of the web may be "baggy" or the center of the web may be "baggy" with the edges tight. The net result is that the prior art, conventional decurlers could not readily evenly decurl webs which initially had uneven curl profiles.

SUMMARY OF THE INVENTION

The present invention provides a method and apparatus for decurling a web with both an even and, particularly an uneven, cross directional curl profile.

The decurling method and apparatus of the present invention comprises the steps of leading a paper web which may contain a precurl, say as due to being wound onto a roll core, onto a bowed roll (also sometimes called a "Mount Hope" roll), the web being wrapped around a portion of the periphery of the bowed roll. As is conventional, the bowed roll has a "bow" or high point on one side (the convex side) and a low point on the opposite side (the concave side). Operating the bowed roll, depending on the amount and direction of the bow, can cause a spreading or cross tensioning effect on the web to remove baggyness when decurling from the paper web. This spreading effect is determined by the bow roll setting, that is, where the high of the bow of the bowed roll is aimed in relation to the web, the degree of bow, and wrap angle of the web on that roll. With the high point of the bow set in a direction perpendicular (90°) to a line that bisects the wrap angle of the web on the bowed roll, a normal operating position is determined. With the bowed roll so set, it causes an even spreading or cross tensioning effect. If that angle is changed so that it is acute (less than 90°), the center of the web is tightened. If the angle is changed so that it is obtuse (greater than 90°), the edges of the web are tightened. The spreading effect produced by adjusting the amount of the bow of the bowed roll, alone, may cross tension the web enough so the web distortion (say baggyness) produced by a less than ideal web cross direction profile will be pulled tight for decurling. As noted, the bowed roll mounting has the ability to aim or rotate the direction of the bow so that it is more or less than 90 degrees to the line that bisects the web wrap angle around the bowed roll. When this angle is less than perpendicular, the web will be tightened up in the center. Likewise, if the angle is more than perpendicular the web will be tightened up on both edges. The amount that the bow has to be aimed or rotated is dependent on the amount of the web distortion for which to be compensated and the magnitude of the bow in the bowed roll. The degree of bow in the bowed roll can be varied and/or adjusted, this adjustment being conventional in the bowed roll's construction.

The decurling method and apparatus of the present invention includes a decurler assembly which may include either a stationary radiused bar or edge or a small diameter, rotating roll. The decurler bar or roll is located adjacent and, preferably, closely downstream of the bowed roll. The web can be displaced, with the decurler (be it a radiused bar or small diameter rotating roll) to load the web in a direction opposite of the precurl, a sufficient distance to remove most, if not all, of the precurl. In addition to their other functions, the first roll in front of (upstream) and behind (downstream) of the decurler act as support rolls to support the web for the decurling operation. In the preferred method, a lead in roll is also provided, and the web is first lead onto the lead in roll and then over the bowed roll. The lead in roll, the bowed roll, the aim of bow, and the motion of the decurler are controlled so that as the decurler is engaged further into the web, the wrap of the web around the bowed roll is kept essentially constant, both in wrap angle and relative aim of the bow to web.

The method and apparatus of the present invention also includes a lead out roll onto which the web is lead from the decurler. Unlike the prior lead out rolls, that of the present invention is not fixedly mounted, but is mounted so that its relative position with respect to the decurler can be changed. Optimally, additional decurling control may be provided by inclining or skewing the lead out roll up or down or to one side or the other of the web to further load one or the other side and its adjacent edge of the web as needed. If desired, or instead, the bowed roll could be constructed to be skewable or inclinable to the web to address a general side to side uneven web curl profile. In the present invention, the bowed roll and lead out rolls can act as the support rolls for the decurler bar or roll and support the web for the decurling operation or step.

In the decurler apparatus and method of the present invention, for decurling a paper web the upstream bowed roll and decurler work substantially independently, but yet in conjunction with one another. Preferably, the bowed roll and decurler bar are mounted on a decurler carriage so that each is independently adjustable without effecting the operation of the other. Thus, the personnel or operator can make proper adjustments of each more readily. In the preferred form, the bowed roll is mounted and powered so that the position of the high point or "bow" in the roll can be radially aimed or changed to say ±90° from its normal, neutral position to change the aim of the bow relative to the web, as desired, to eliminate or limit baggyness in the web prior to decurling. That is, the best position for the bow of the bowed roll is selected to set up the web by reducing or removing baggyness during the decurling operation to permit the downstream decurler bar or roll to work better. Preferably, the bowed roll is adjusted to eliminate or reduce the baggy portion of the web before it reaches the decurler bar or roll. After decurling, some or all of the baggyness may reappear. The decurler bar or roll is mounted so that it can be driven a desired distance into the web in a direction to counteract the initial curl or precurl to eliminate or limit any final curl. Preferably, the decurler bar or roll moves or pivots some distance from but generally about the axle or axis of the bowed row.

As noted, the decurler assembly also may preferably comprise an upstream lead in roll. The lead in roll also is movably mounted with respect to the bowed roll, and preferably spaced some distance from and mounted to move generally about the axle or axis of the bowed roll. This mounting of the lead in roll can keep a generally consistent wrap of the web on the bowed roll in relation to the direction of the bow in the bowed roll, even if the decurler bar or roll is moved into or away from the web to increase or decrease the amount of decurling action. For simplicity, the decurler bar or roll and lead in roll may be spaced apart on opposite sides of the bowed roll and each mounted on a pair of pivoting but connected carriage plates or arms, which are, in turn, mounted on the frame so both the lead in roll and decurler bar or roll pivot together (rotating) about the bowed roll axle, axis or center line. In normal operation, where the decurler bar or roll may engage the web at an ever increasing amount as the unwinding paper roll decreases in diameter to compensate for additional precurl, the web wrap around the bowed roll can be consistently maintained because the upstream lead in roll is rotating generally about the same point on the decurler support frame. Also, the bow may be kept in a desired selected relationship to the web because the axle of the bowed roll and its adjustment for aiming the bow in the desired direction also rotates with the rest of the decurler as mentioned. In this way, engaging or principally disengaging the decurler into the web will minimize or eliminate any changes in effect on the aim and other settings of the bowed roll.

Additional to the lead in roll, the decurler apparatus, as noted, can be provided with a lead out roll downstream of the decurler bar. The lead out roll may be made adjustable relative to the decurler bar. Preferably, the lead out roll is mounted so that at least one end can be adjusted, moved or raised or lowered in or out relative to the normal web path so as to incline or skew the lead out roll to stretch one or the other side or edge of the web more as is needed to overcome a "loose" web edge on one side or the other of the web. By varying the amount of bow, the relationship of the direction of the bow to the web, the amount the decurler bar or roll engages the web, and skewing or inclining adjustment of the downstream (lead out) roller, many adjustments and/or combinations can be had to overcome a less than ideal web curl profile, thus maintaining a consistent decurl across the web and resulting in flat or at least flatter sheets, particularly for webs with an uneven cross direction curl profile.

Further means are provided for maintaining the relative orientation of the decurler even though the mounting plates or arms of the carriage or frame for the decurler and lead in roll pivot. Yet further means are provided for controlling the movement of both sides of the mounting arms relative to the carriage so that they move together; that is so no undesired twist is induced into the apparatus.

The method and apparatus of the present invention can be used in any process or apparatus wherein a paper web will eventually be, at some subsequent time, either in that process or apparatus or another, in sheet form, such as in the paper converting field in a sheeter, or in a web press wherein the output is eventually made into sheets or press signatures.

DESCRIPTION OF THE PREFERRED EMBODIMENTS

Figure 8:
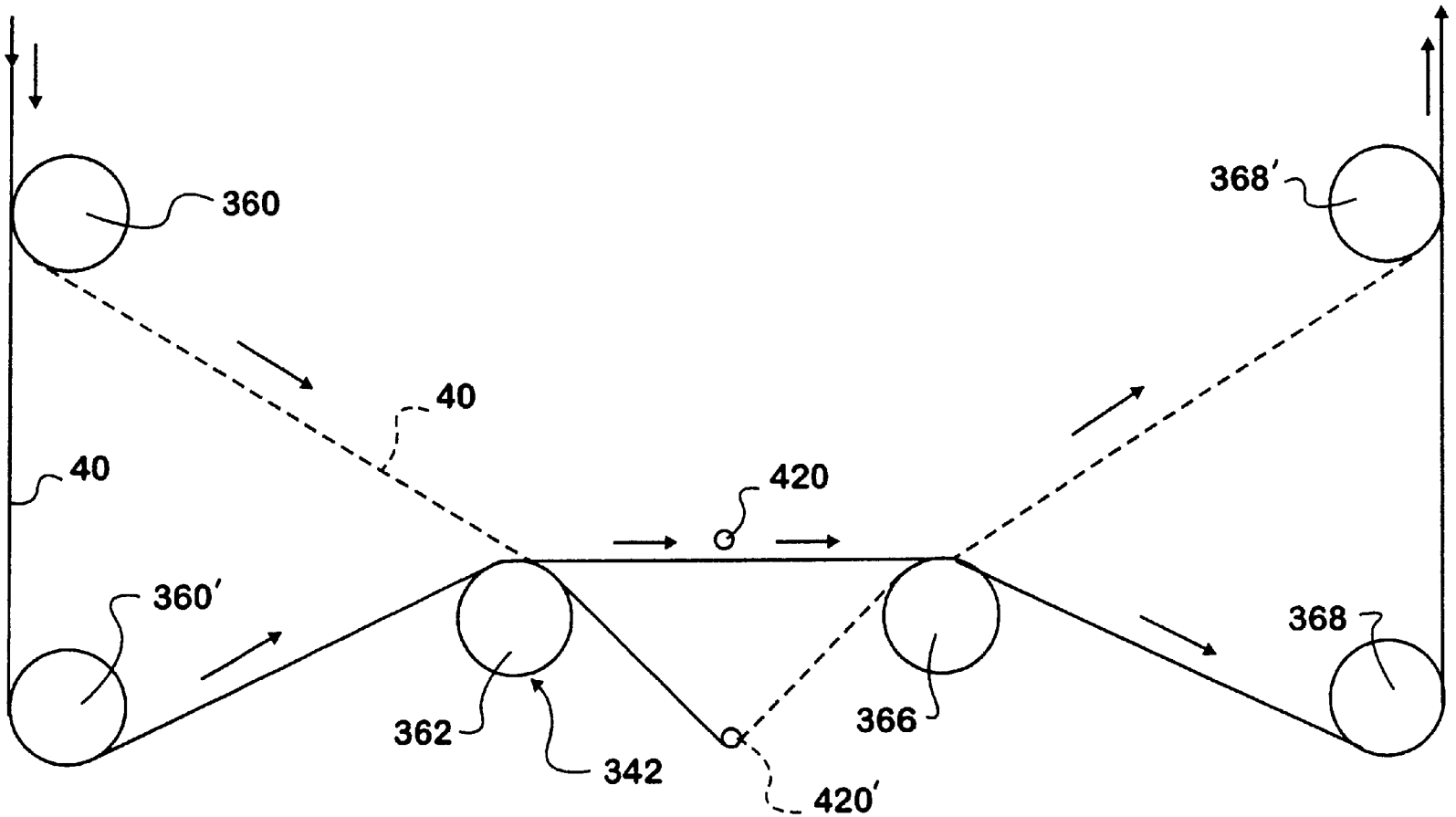
FIG. 8 is a schematic of alternative embodiments of decurling methods and apparatuses of the present invention.

The decurling apparatus of the present invention for carrying out the decurling method of the present invention is shown in FIGS. 1 to 8. FIGS. 1 to 7 show a first embodiment of decurl apparatus and method, while FIG. 8 shows alternative embodiments and methods which will be subsequently described.

Figure 1:
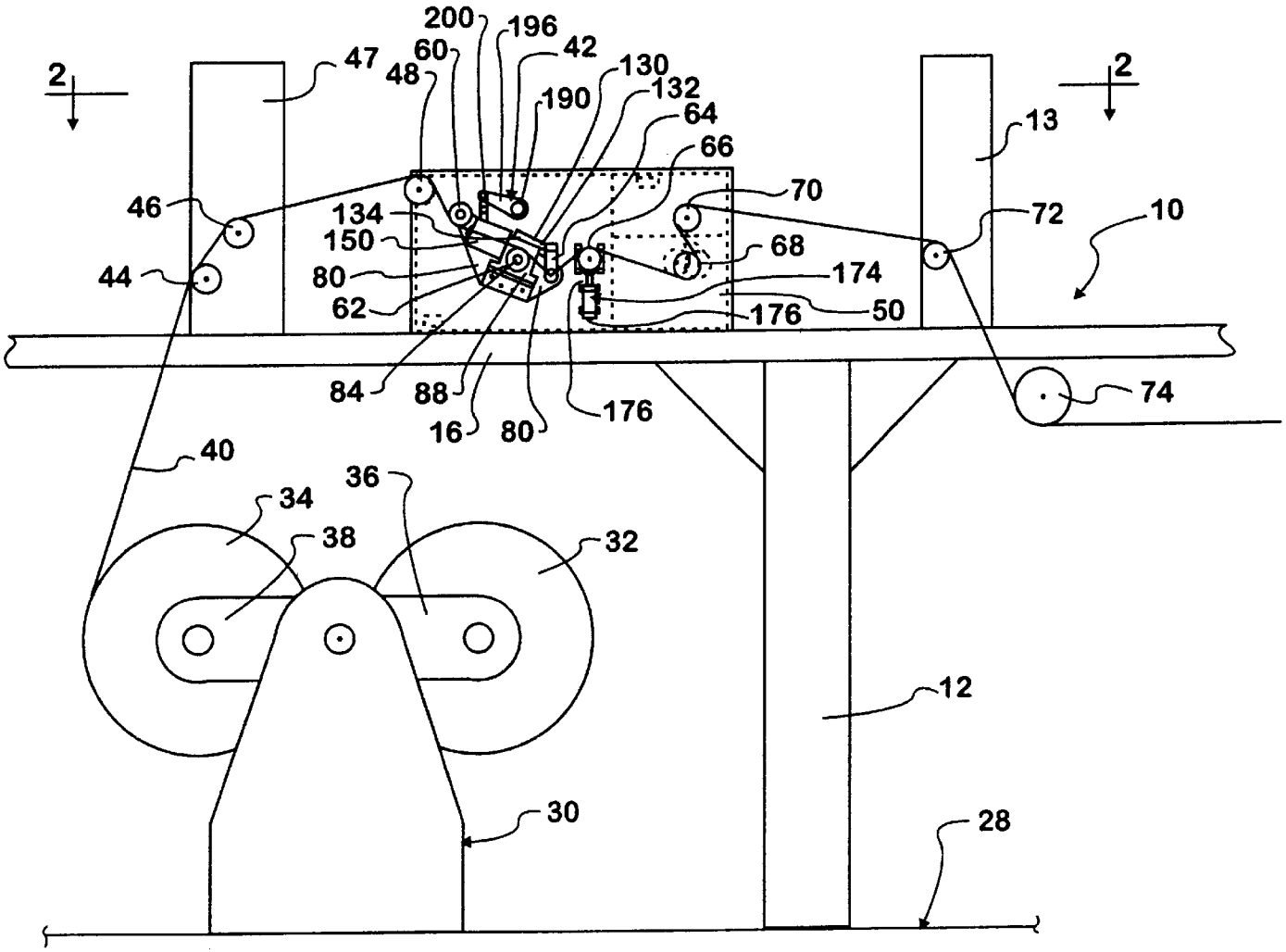
FIG. 1 is an elevational schematic view of a decurler apparatus of and utilizing the method of the present invention shown incorporated into a portion of paper web converting machinery, in this instance, a sheeter.

Referring to FIG. 1, for purposes of describing this invention, it is shown installed on a sheeter 10. As was noted, a sheeter is a paper converting machine which cuts paper webs generally wound in rolls into smaller sheets. As shown in FIG. 1, the sheeter 10 has a frame comprised of various pairs of vertical members 12, 14 (behind 12) and horizontal members 16, 18 (behind 16) resting upon a floor or bed 28. The frame and its members carry various operational parts of the sheeter, including an unwind stand 30 which, in turn, carries a pair of paper rolls 32 and 34 on pairs of roll mounting arms 36 and 38 with a web 40 being taken off of the roll 34 and lead into the rest of the sheeter. The decurling assembly 42 of the present invention, method and apparatus, is shown in FIG. 1 mounted to the frame generally above the unwind stand 30. It should be understood that the decurler could, of course, be mounted elsewhere or utilized on a different piece of equipment than a sheeter.

Figure 2:
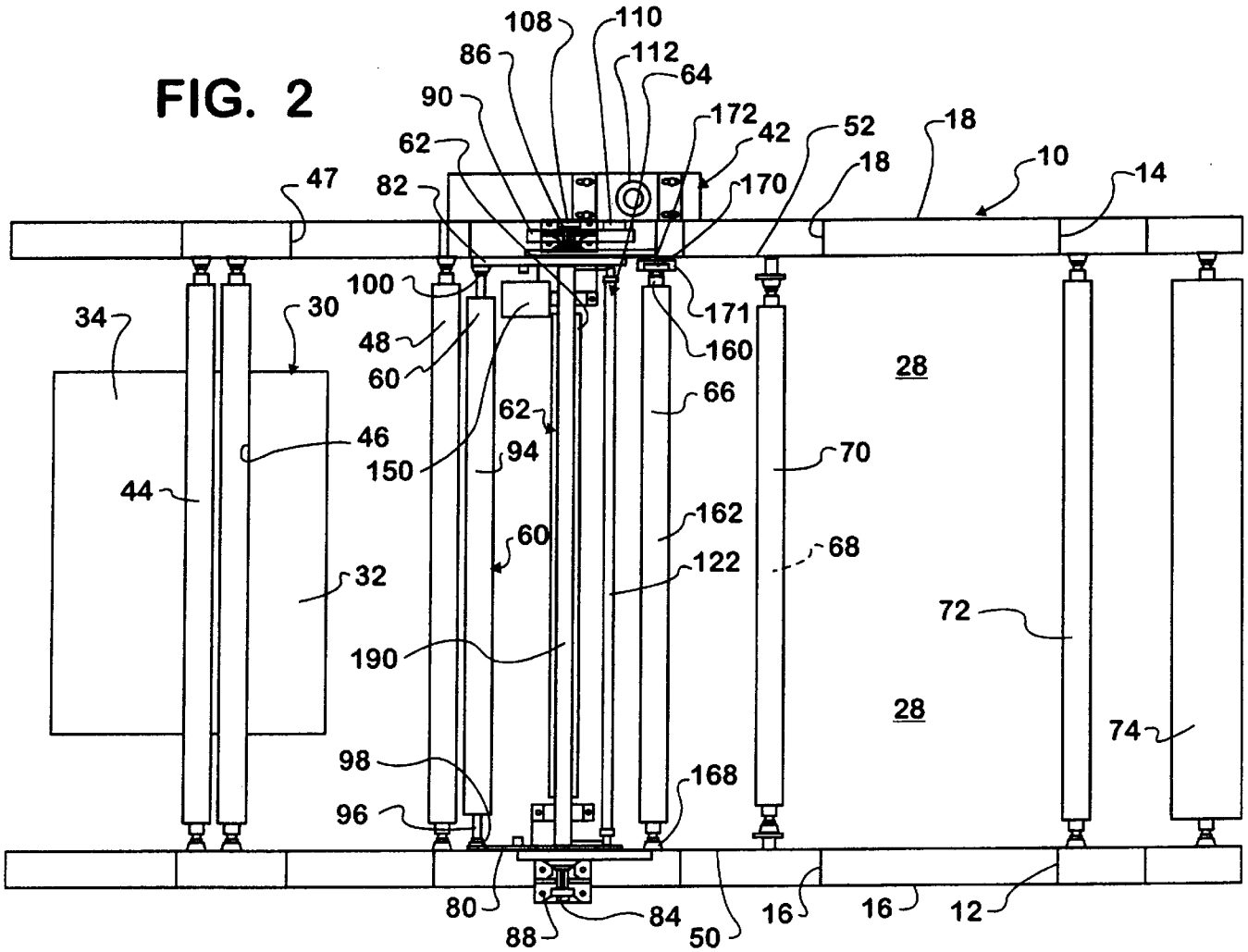
FIG. 2 is an enlarged top view taken along the line 2—2 of FIG. 1, without the paper web being threaded through the sheeter and the decurler.
Figure 3:
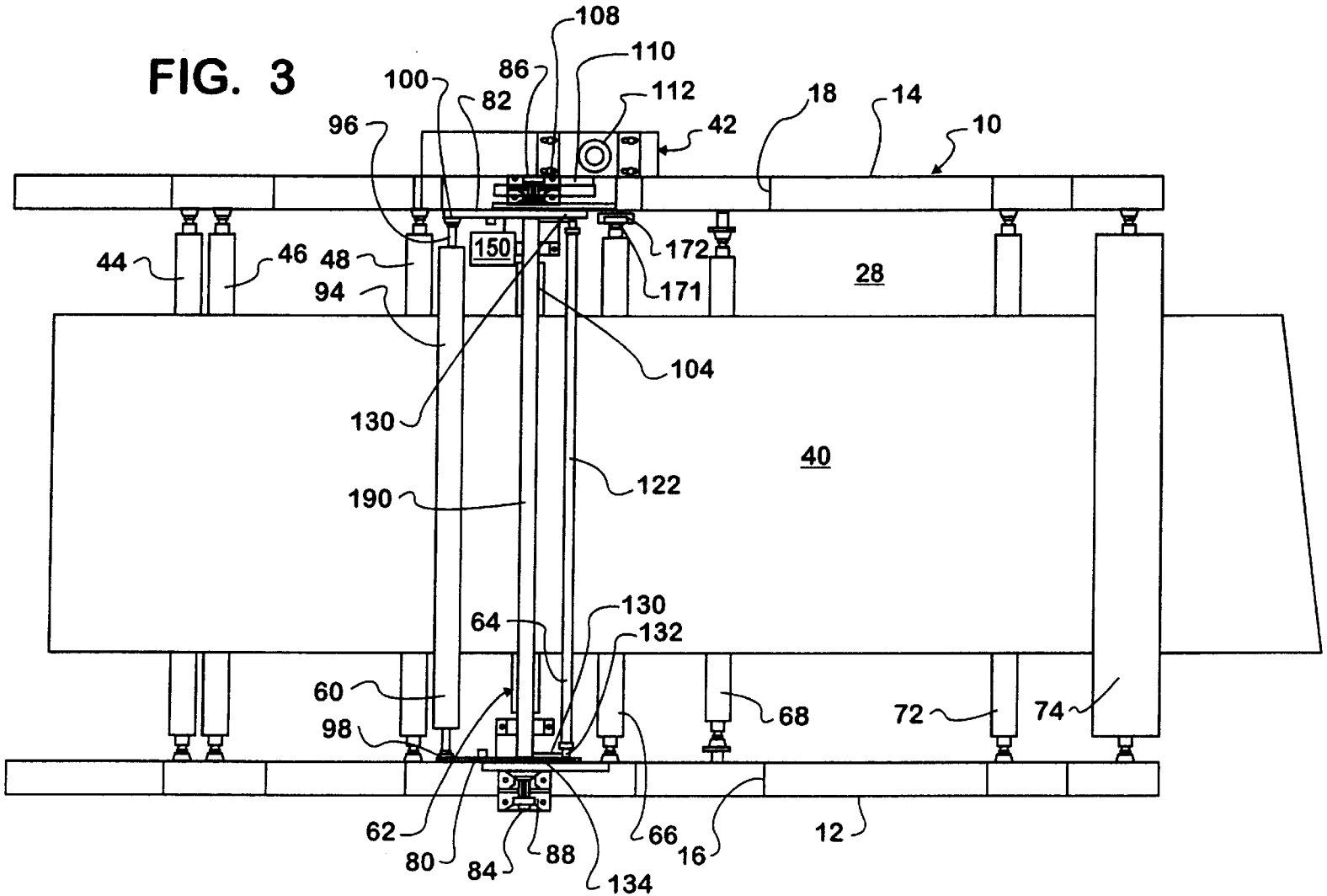
FIG. 3 is a view similar to FIG. 2, but showing the paper web, as shown in FIG. 1 but with the web threaded through the sheeter and decurler.
Figure 4A:
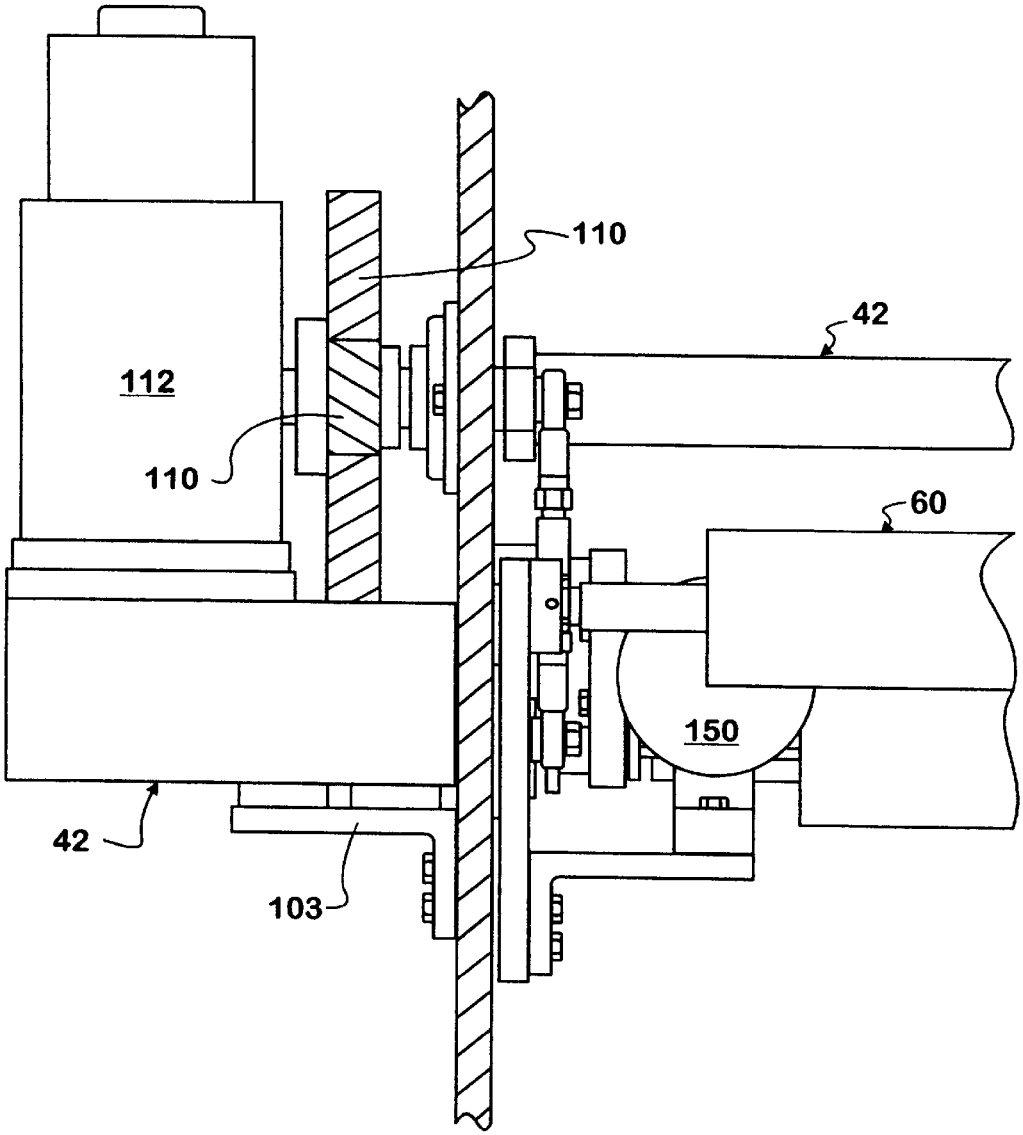
FIG. 4A is an enlargement of the left side of FIG. 4 showing the details.
Figure 4B:
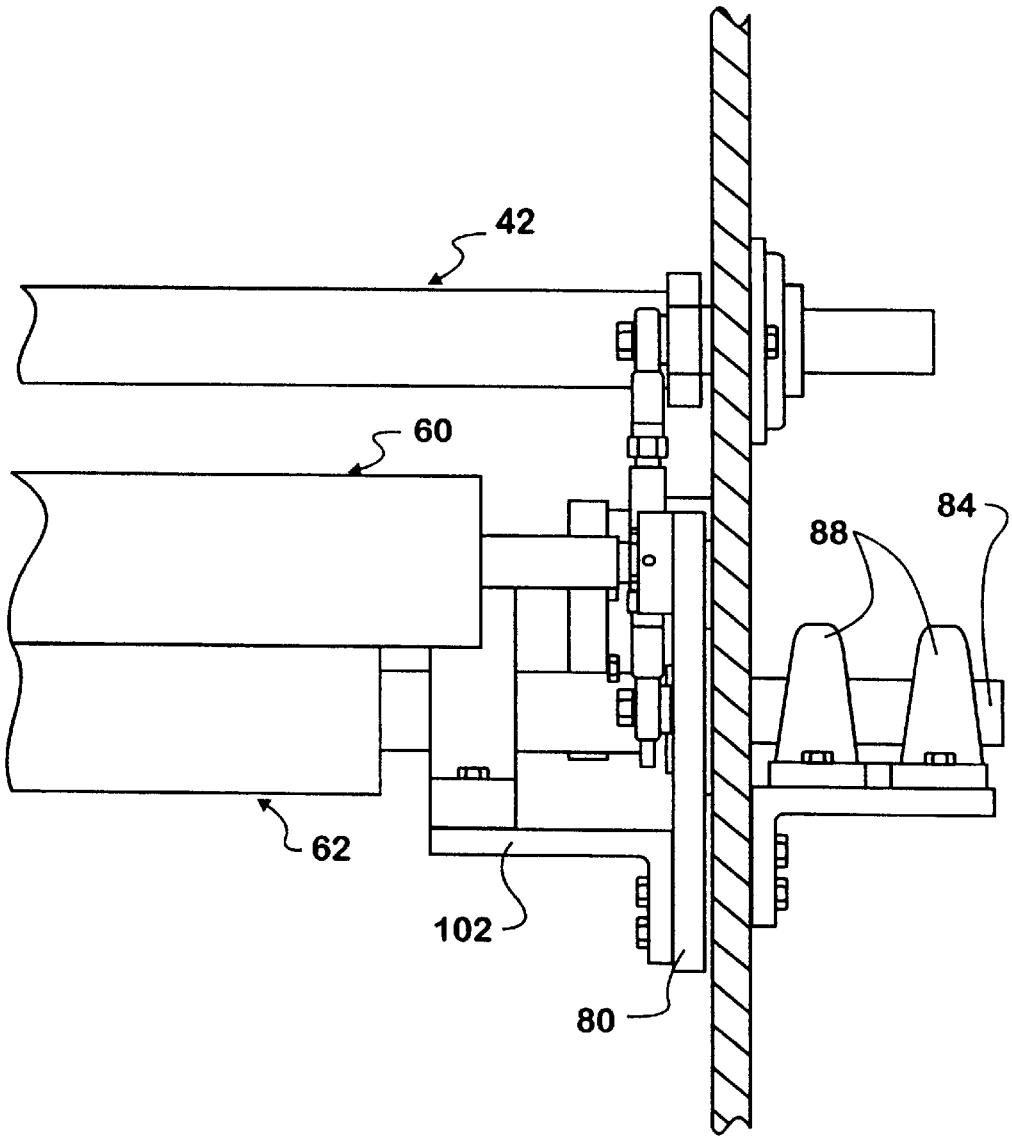
FIG. 4B is an enlargement of the right side of FIG. 4 showing the details.
Figure 4:
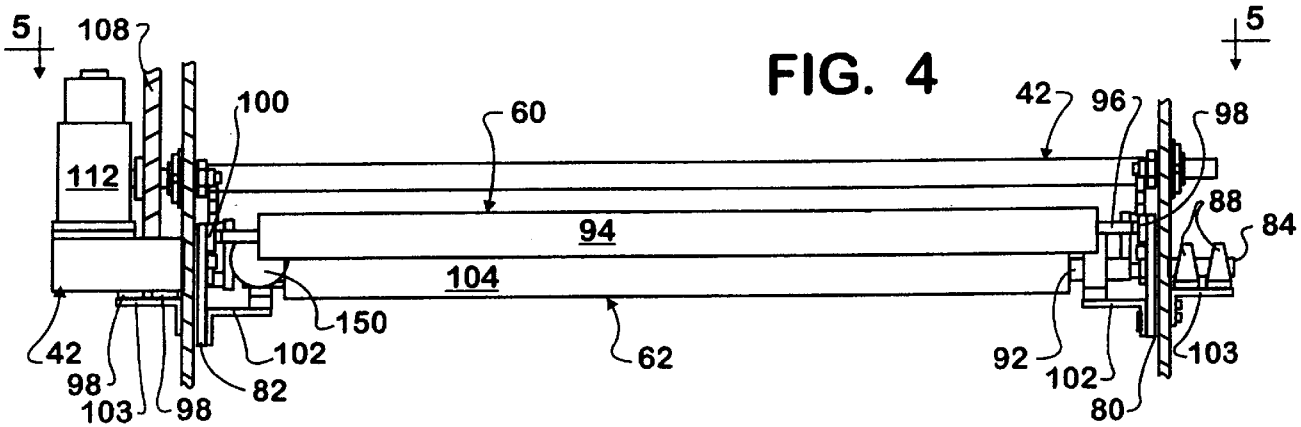
FIG. 4 is a yet further enlarged elevational view, similar to FIG. 2 of just the decurler to better illustrate its construction.
Figure 5:
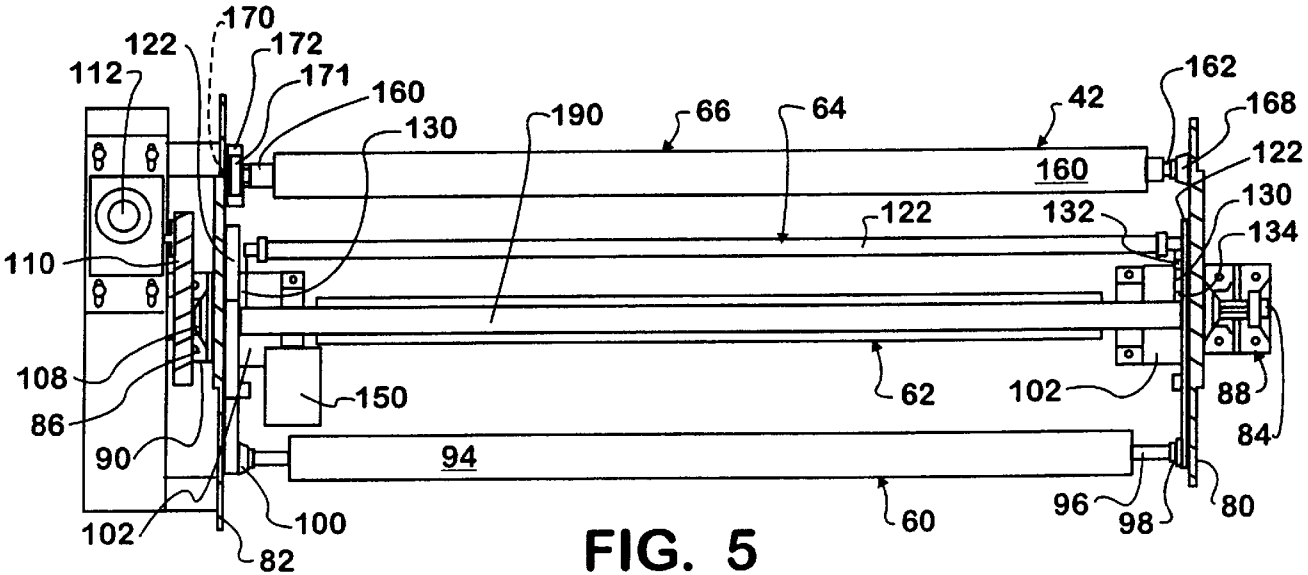
FIG. 5 is a top view taken along the line 5—5 shown in FIG. 4.
Figure 5A:
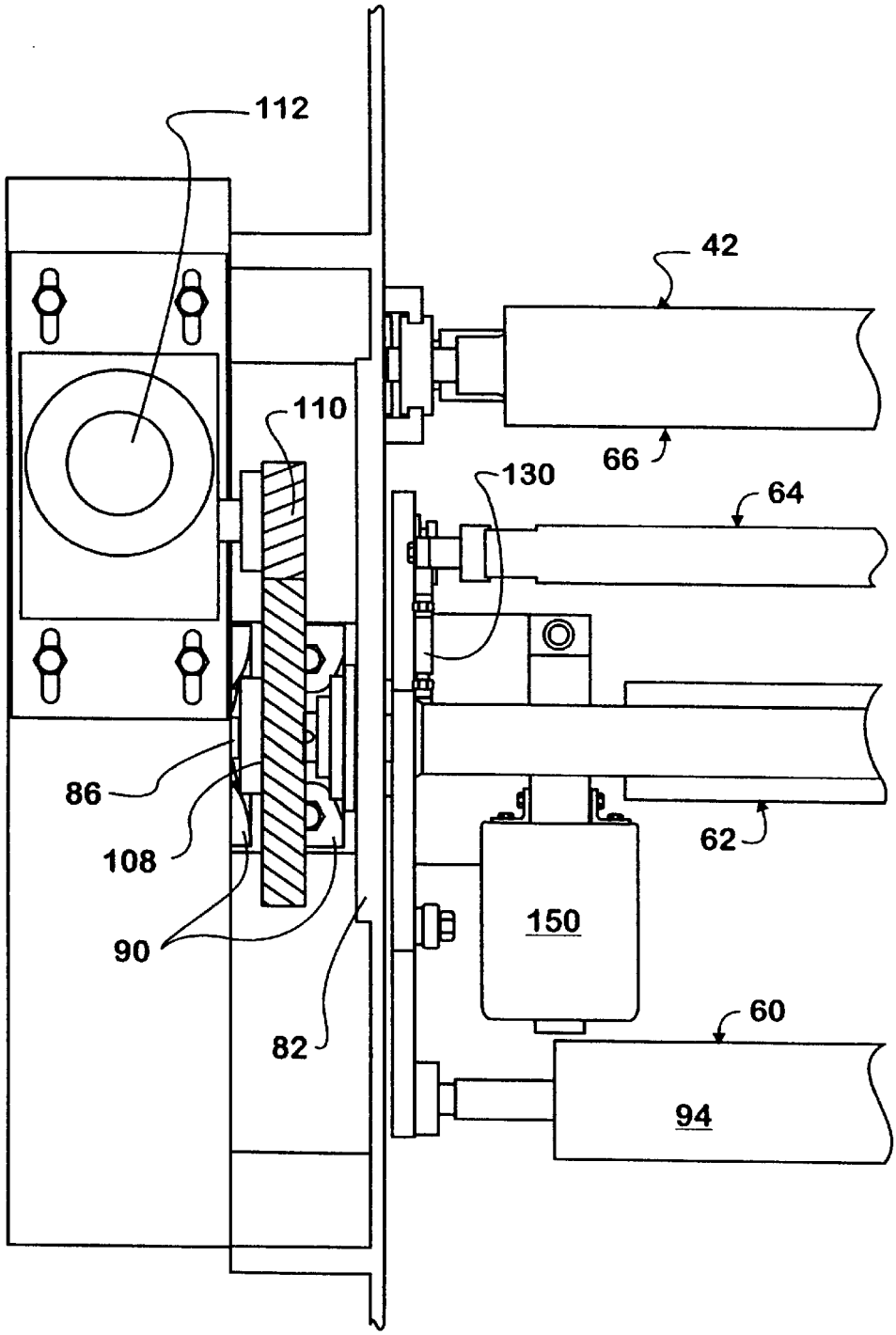
FIG. 5A is an enlargement of the left side of FIG. 5 showing the details.
Figure 5B:
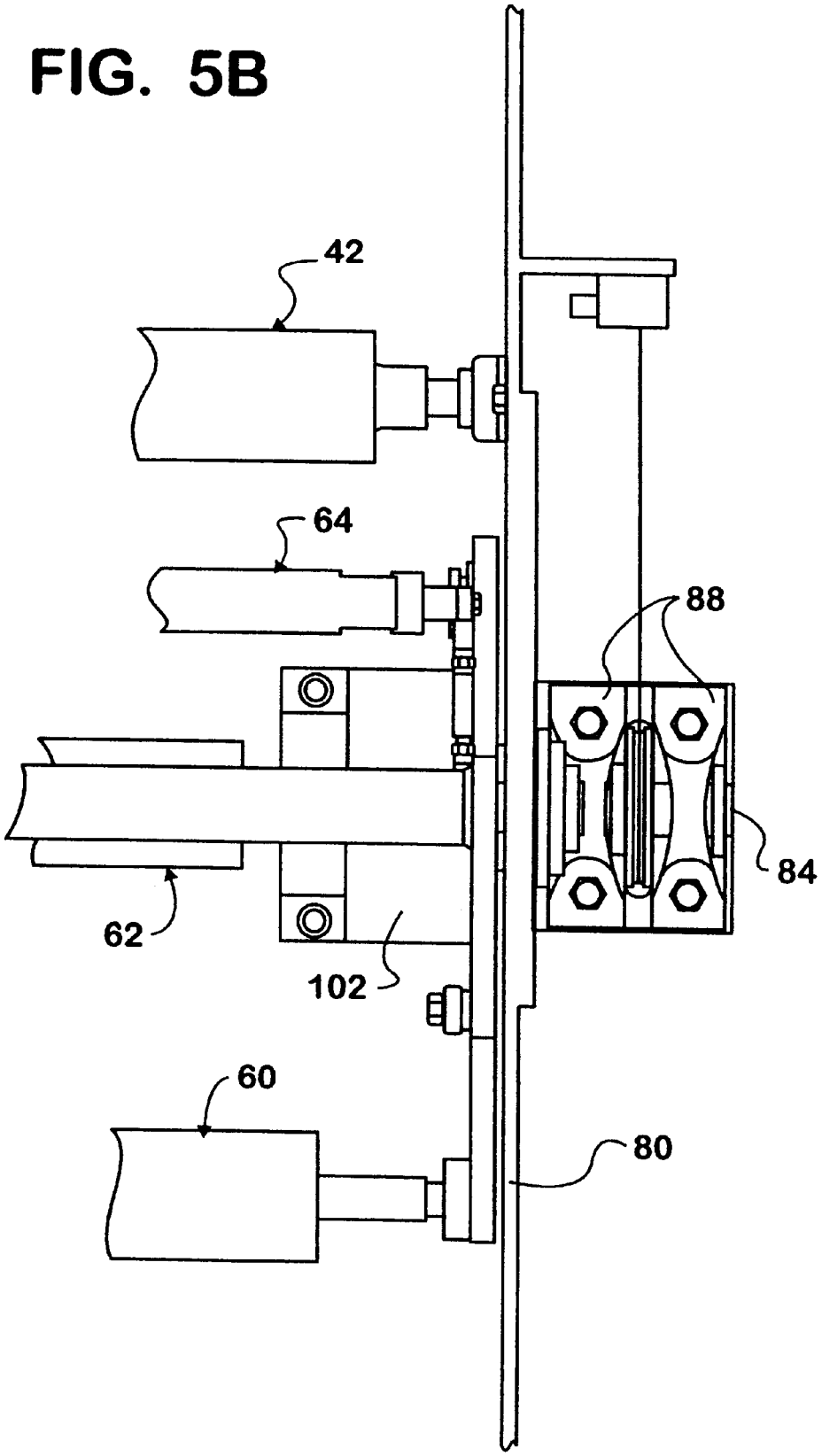
Figure 6:
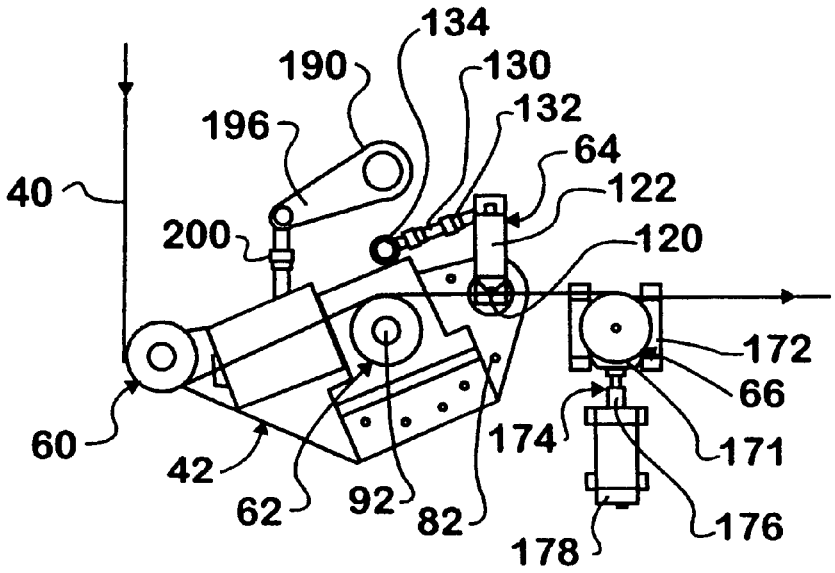
FIG. 6 is a schematic view showing the decurler in a disengaged position.
Figure 7:
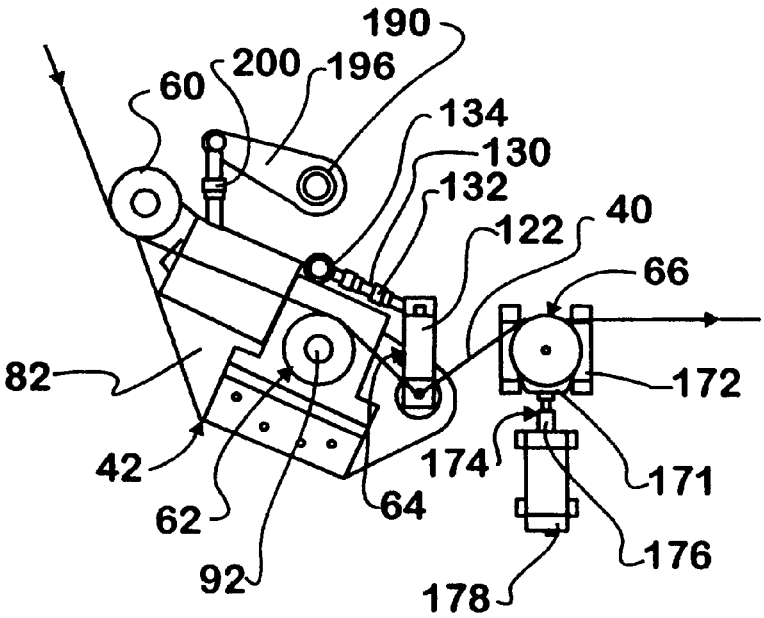
FIG. 7 is a schematic view showing the decurler in a fully engaged position.

As shown in FIG. 1 in elevation, FIG. 2 (plan view without the web) and FIG. 3 (plan view with the web threaded in place), the web 40 of roll 34 is lead upward over a pair of rolls 44 and 46 mounted on the vertical member or stand 47. From there, the web 40 is lead onto a roll 48 which then leads into the decurler mechanism of the present invention. The roll 48 and the decurler of the present invention 42 are carried upon a pair of upward, fixed, frames or stands 50 and 52 (behind 50). For now, we will just describe the path of the web in general, and then go back in detail.

In its preferred form, the decurler assembly 42 may comprise a lead in roll 60, a bowed roll 62, a decurler bar or roll 64 and a lead out roll 66. As is shown in FIG. 1, the web passes under the lead in roll 60, over the bowed roll 62, under the decurler bar or roll 64, and over a lead out roll 66. From the lead out roll 66 of the decurler 42, the web then passes over successive rolls 68, 70, 72 and 74 to the rest of the sheeter, which is conventional in construction and will not be described. The roll 68 is swing mounted, as indicated by the dotted lines, and functions along with other equipment to detect and keep tension on the web.

Now that the general path of the web in the decurling assembly 42 of the sheeter has been described, we can concentrate on the construction and operation of the decurler assembly and decurler method of the present invention.

As shown, the side frames or stands 50 and 52 function to provide support for the rest of the decurler assembly apparatus. As shown, roll 48 is mounted to the stands 50 and 52 in a conventional manner. Carried on the stands 50 and 52 is a movable carriage for the decurler assembly, generally comprising mounting plates or arms included, in this instance, in the form of a pair of spaced apart carriage plates 80 and 82 (in FIG. 1 behind 80). These carriage plates 80 and 82 have short axles 84 and 86 (see FIG. 2) secured perpendicularly thereto, and they are pivotably mounted to the sheeter frame and/or specifically onto the side stands 50 and 52 by sets of bearings 88 and 90 (see FIG. 2). These bearings are located to generally cause the axles 84 or 86 mounted on the carriage plates 80 and 82 to coincide with the axis or axle 92 (see FIGS. 2 and 4) of the bowed roll. These bearing sets 88 and 90 are mounted on brackets 103 secured to the side frames 50 and 52. Thus, the carriage plates 80 and 82 can pivot on the bearings 88 and 90 in a manner so that these plates will pivot about the decurler's bowed roll axle. While the two carriage plates are shown in this instance, they could also have been made in other forms, such as narrower arms, say two, one on each side upstream of the bowed roll and two, one on each side downstream of the bowed roll, but connected to each other and/or at least to the other arm on its same side. Thus, the two arms on the same side would move together.

The lead in roll 60 is conventional (being a dead shaft roll), having a rubber cover 94 and rotating on its axle shaft 96. The shaft 96 is, in turn, mounted by brackets 98 and 100 secured to the carriage plates 80 and 82. As noted above, the bowed roll is also mounted on or to the carriage plates 80 and 82 . To this end, a pair of "L" shaped brackets 102 (FIG. 4) are mounted to the plates 80 and 82 and the bowed roll structure is, in turn, mounted to the brackets 102 so that the axis of the bowed roll will generally coincide with the pair of axle shafts 84 and 86 mounted to the exteriors of the plates 80 and 82. As was noted, the axle shafts 84 and 86 are, in turn, mounted in bearings on brackets 103, mounted on plates 50 and 52. The bowed roll can be of the type manufactured and sold under the trademark "Mount Hope" roll manufactured by the Mount Hope, a division of the BTR Paper Group. As the construction and operation of a "Mount Hope" or bowed roll, itself, is conventional and known, it will not be further described, except in conjunction with the present invention. It will suffice to say that the axis or axle and outer "cylinder" of the roll can be curved to follow a shallow arc rather than being straight, quotation marks being used as the roll body may be varied from a true cylinder. Thus, the roll can be given a bowed shape with a high point on its convex side and a low point on its concave side, as is conventional.

While the bowed roll shown in the drawing should actually be bowed somewhat, the bow is so slight it would not be readily apparent in the drawings of this scale, and has not been illustrated. The bowed roll 62 has an outer core 104 which can also be bowed and is carried on the axle or shaft 92. The bowed roll 62 is also mounted onto the carriage plates 80 and 82, via angle brackets 102. As noted, the movable carriage plates themselves are carried and pivotably mounted to the fixed plates 50 and 52. The carriage plates 80 and 82, decurler bar 64 and lead in roll all are caused to pivot when they are moved by tie rods 200 which will be more fully described below in conjunction with the torque shaft 190.

The decurler bar or roll 64 is also mounted on the carriage. When the decurler is a rotating rod it is backed up by decurler bearings (not shown and conventional) carried on a decurler frame or beam (as is conventional) that extends across the sheeter and the web. End brackets 123 are provided for the decurler beam and carry stub shafts 124 rotatably or at least pivotably mounting the decurler (bar and its beam) to the carriage formed by plates 80 and 82. A decurler pivot bar 130 is provided at both ends to maintain the decurler in relatively the same general, vertical orientation (perpendicular to the web at its center of contact), even though the carriage may be pivoted. End 132 of this pivot bar 130 is mounted to the decurler end plates 122 and its other end 134 pivotably engages or is connected to the sheeter frame 50/52 and/or mounting plate thereof In order to change the aim of the bowed roll 62 with respect to the carriage and the lead in roll 60 and decurler 64 carried thereon and, of course, the web fed therethrough, a gear motor 150 is provided as is conventional. As this is the standard and conventional motorized Mount Hope roll construction, it need not be further described. The motor 150, like the motor 112, can be wired to be controlled at the site and/or remotely, say from an operator station. The gear motor 150, of course, operates through its adjacent gear box to turn the axle or shaft of the Mount Hope roll to change its aim. While not shown here in the drawings in detail, bowed rolls are available and could be provided with a means to alter the degree or amount of bow, which could be manual or powered say electrically or by fluid, air or hydraulic power. Of course, the other motors described herein could also be powered by any of the above sources, or if adjustments are infrequent or ease of making is not important, by manual means.

Also fitted to the frames 50 and 52 is the lead out roll 66, which can have at least one of its ends (here 160) moved relative to the carriage. As is shown, the lead out roll 66 is a live shaft design with suitably covered face and attached axles 160 and 164. To this end, bearings 168 and 170 are provided on the ends of the shaft. One of the bearings 168, which could, but need not, be of a spherical type to accommodate movement, is fixed to the plate. The other bearing 170, which could be of a similar type, is mounted to a car 171 riding on a double track or guide 172. Thus, the second bearing 170 can be moved about to alter the relative slope of the roll 66 to the web 40 and the rest of the decurler. The track or guide 172 is in turn mounted to the plate 50. Means are provided to locate the car in a selected position on the track or guide. To change the position of the one end of the lead out roll, its end shaft and bearing relative to the track or guide, plate, sheeter frame and web, an adjustment and locking means mechanism 174 is provided. In this instance, the adjustment and lock is in the form of a powered screw jack 176 having a motor 178 which turns a screw to move the car 171, and consequently moves one end of the lead out roll 66 up and down. While a live shaft lead out roll is shown, the invention could also be adapted to dead shaft construction. Likewise, the lead in roll, or for that matter many of the other rolls shown, could be of either live or dead shaft construction.

The present decurler assembly was designed to be retrofitted into the limited space provided in an existing sheeter carrying out the prior art decurling operations, there was need to minimize the bulk and size of the decurler assembly 42 and its carriage. Because the space is somewhat limited and the previously described features connecting the two sides of the carriage plates 80 and 82 together have limited rigidity, it was desirable to provide a torsion shaft 190 to connect the two side carriage plates 80 and 82 together so that they pivot together. To this end, the torque shaft 190 is carried in bearings 192 and 194 mounted to the structure frame and/or plates 50 and 52. This torque shaft carries on each end torque arms 196 secured thereto in a non-rotative manner. The other ends of the torque arms are pivotably attached to one or upper ends of tie rods 200 at each side. The tie rods 200 in turn are pivotably attached to the carriage plates 80 and 82 so that these two carriage plates will move or pivot together. For similar reasons of adding rigidity, the shafts 84 and 82 are long enough to be carried by double sets of large bearings 88 and 90 shown on each side.

As is noted above, the torque shaft 190 is also utilized to pivot the carriage formed by plates 80 and 82, and thus the decurler and lead in roll about the bowed roll. To this end, one end of the torque shaft 190 extends out to the left (as shown in FIGS. 2 and 3) through a cutout in the frame 52, and carries a large, in this instance straight, or other gear 108 thereon keyed to turn with the shaft end 84. The large gear 108, in turn, meshes with a smaller, compatible gear 110. The gear 110 is, in turn, mounted on the output shaft of a gear reduction motor 112. This gear reduction motor 112 is, in turn, mounted to the fixed plate 50 on frame of the sheeter 10. The gear reduction motor 112 can be controlled from various locations such as of the site and/or from a remote operator station. Operation of the gear motor 112 will turn gear 110, which in turn turns gear 108 and the torque shaft end 190 to change the positions of the torque arms 196 and tie rods 200 to pivot the carriage formed by plates 80 and 82 and also the positions of the lead in roll 60 and decurler 64, with respect to the frame of the sheeter and bowed roll 62. The bowed roll, itself remains relatively stationary (as it is located at the pivot center), while the lead in roll 60 and decurler 64 pivot about the bowed roll as the motor 112 changes the position of the carriage plates 80 and 82. Alternatively, if the construction is robust enough, the axles 84 or 86 one or both, could be fitted with the gear drive to pivot the carriage plates 80 and 82.

From the foregoing, the operation of the decurler assembly 42 of the first embodiment is as follows: The web 40 is fed through the sheeter 10 and decurler assembly 42 as shown in FIGS. 1 and 3. The sheeter is operated so that the web moves from off of the paper roll 34 (or paper roll 32 when paper roll 34 is exhausted) to the decurler assembly, then into the downstream end (not shown) of the sheeter that is to the right of roll 74, wherein the decurled web would be eventually cut into sheets. In the decurler, the bowed roll 62 is adjusted to minimize or eliminate the effect of baggyness while decurling. The decurler bar or roll 120 is moved downward from the unloaded position (shown in FIG. 6) to, or somewhere in between, the fully loaded position (shown in FIG. 7) as desired or needed to remove the precurl in the web as it comes off the paper roll 34. Of course, as the decurler bar or roll 120 is moved, the lead in roll 60 pivots in the same rotational direction about the bowed roll 62 and its axles 84 and 86 to keep the wrap and the angle of contact of the web 40 about the bowed roll's outer surface essentially constant. Of course, the motors 150 and 112 control the desired aim of the bowed roll and the amount or distance the decurler bar engages web. Likewise, the tipping, skew or inclination of the lead out roll 66 can be adjusted via operations of the motor and jack screw 174–176 to account for one edge or the other needing more decurling. These adjustments may be varied by a human operator or automated, to eliminate precurl and result in a flatter cut sheet.

Following are some general discussion and specifics of the decurler shown in FIGS. 1–7. Of course, web width will to some degree determine the size of the machine. Web width could vary from say 19 inches to near 90 inches, but could be other sizes. The web could be of various weights, say from 20 pounds per ream to 300 pounds or more per ream (using a 3,300 sq. ft. ream). Higher weights for paperboard or cardboard could be utilized. As noted, the inclined roll could be moved ±½ inches per side, but the decurler's inclined roll was designed to have up to ±1 inch. Of course, with very wide web, this could even be greater. Generally, an inclination of between ±3° should be sufficient. Generally, the bow in the bowed roll has been run at around 0.75 inches, but the bow in the bow roll could be as much as 2.00 inches.

Generally, the rolls shown (other than the Mount Hope roll) are around 5¾ inches in diameter, but other rolls' diameters could be used say as large as from 15 inches to as small as 1 inch in diameter.

The decurler bar can be set as deep as 12 inches into the web (difference between off and full on positions). Generally the distance between the lead in roll and Mount Hope roll should be at least one diameter. The distance from the lead out roll to the next downstream roll should be at least one diameter. In this instance, the lead in roll and bowed roll or Mount Hope roll are separated about 16 inches, while the Mount Hope roll and lead out roll are separated again about the same distance. The distance from the lead out roll to the first tension roll is about 21½ inches.

In the present instance, the tension rolls 68 and 70 are 5⅞ inches in diameter, the two rolls upstream (not Hope roll) and lead out roll are of 5⅛ inches in diameter, while the decurler is about ⅜ inches in diameter. The downstream idler rolls are between 5 and 7 inches in diameter. Other suitable roll diameters could be from 2 inches to 12 inches.

The decurling bar is about halfway between the bowed and lead out roll and in this instance about 8 inches from the bowed roll. Of course, other positions say from one quarter to three quarters instead of one half could be used.

At the maximum decurler position, the web upstream and downstream of the decurler bar is at about a relative angle of about 97 degrees.

Referring to FIG. 8, a second further sophisticated decurler is schematically shown, and like the decurler assembly 42 of FIGS. 1–7, could be incorporated in another machine or device for converting webs into sheets. As this second embodiment bears relation to the first embodiment, the second will be described with corresponding numerals starting at 342, thus 342 would correspond to 42, etc., the numbers of the second embodiment being 300 higher than that of the first embodiment. As shown in FIG. 8, there is a web 340 which travels off an upstream roll (not shown), then over a vertically adjustable lead in roll 360. The roll 360 is movable in the general vertical direction as indicated (360 being the upper position and 360' being the lower position). Its function is to maintain a consistent web wrap angle on the bowed roll 362 as the decurler bar or roll 420 is engaged or disengaged from the web. Movement of the roll 360 and bar or roll 420 or other portions of this embodiment may be caused by various methods i.e., electrical, controlled by servo positioning system that may used a computer and associated software, or by a mechanical linkage that connects to the decurler bar positioning system or any combination of mechanical, pneumatic, hydraulic or manual positioning. From there the web moves over a bowed roll 362 which is adjustable for the amount of bow and also for the direction (aim) of the bow relative to the web. These adjustments may be made manually, mechanically, electrically or by any combination of and including pneumatic or hydraulic systems. The aim of the bowed roll would be adjusted to keep the desired relation to the web as the decurler bar is engaged or disengaged into the web and may be made by any of the above-mentioned methods. From the bowed roll 362 the web 340 travels under the decurler bar or roll 420 (shown in this instance in its disengaged, upper position in solid lines), out over a lead out roll 366. The roll 366 is adjustable in inclination. This roll is adjustable on at least one end in a direction in line with a line that is perpendicular to the line that bisects the web wrap angle. However, other inclination directions could be used. The line of adjustment should be kept consistent relative to the web wrap angle. However, computer software may be used in conjunction with electrical actuators to achieve this or a similar result. Alternatively, other means than electrical actuators could be used, such as utilizing mechanical, hydraulic or pneumatic systems. From the lead out roll the web moves under a vertically adjustable roll 368 (the roll 368' shows its upper position), finally passing to the rest of the device downstream of the roll 368, wherein the web, after being decurled is cut into sheets. The outfeed roll 368 is movable in the general or vertical direction indicated; it's function is to maintain a consistent web wrap angle on roll 366 as the decurler bar is engaged or disengaged. Like roll 360, movement may be via any of the mentioned or other devices or methods. The web 340 and rolls 360 and 368 and decurler bar 420 are shown in solid lines in their decurl "disengaged" positions and in dotted lines or prime number (420') in what would be their decurl "fully engaged" positions. Of course, any positions between disengaged and fully engaged can also be obtained and used.

As is noted above, various mechanisms known to persons skilled in the art can be used to achieve the desired movement of rolls 360 and 368 and decurl bar or roll 420. For example, the rolls 360 and 368 and decurl bar may be mounted on vertical tracks and moved by motorized jack screws or any other actuator or device capable of controlled movement such as linear motors. The advantage of the system is that all web and roll and roll wrap relationships can be kept constant while the decurler bar or roll movement into web is varied or changed as needed to eliminate or at least minimize precurl. Of course, the bowed roll 362 aim and amount of bow can be altered to address baggyness while decurling, as well as the lead out roll inclined as needed to handle variations in edge to edge decurl profile.

In a simplified version of the FIG. 8 layout, rolls 366 and 368 also could be stationary idler rolls without any movement. In this simplified variation, the roll 362 then would maintain the same function as just described. However, it also takes on the function of roll 366. In this simplified configuration, the bowed roll 362 would be constructed to also be adjustable in skew or inclination to carry out the additional function of the prior described roll 366. The advantage to this arrangement is the elimination of the complexity needed to move roll 366 and roll 368 as the web wrap angle is already being compensated for by roll 360.

Another variation would be to have rolls 360, 362 and 368 in the form of stationary idler rolls with rolls 362 being a straight sided cylindrical instead of bowed, roll and rolls 366, and 368 structured and operating as discussed above. Of course, in the latter configuration, the advantage of the bowed roll in eliminating or reducing baggyness while decurling would not be present, and the device described in this paragraph would function similar to a conventional decurler.

While various embodiments of the decurl method and apparatus have been disclosed and/or described, it should be understood that there could be variations on steps and structure. For example, the web, rolls and decurler could be oriented differently so that for example, the decurler bar or roll moved up to engage the web, rather than down, or for that matter moved in any other direction. By inverting the system components, decurl could take place in the opposite direction (inducing down curl). Of course, the present invention could be designed to use either live shaft or dead shaft rolls for all but the bowed roll.

While specific structures are shown, there are many alternative equivalents known to those skilled in the art. For example, a computer or Programmable Logic Controller (PLC) could be used to control the positions of the various movable rolls and decurler bar or roll and bowed roll. The computer could be provided with feedback from downstream to adjust the decurler automatically to remove precurl. Also, the order of operation could be varied. For example, the bowed roll could be downstream of the decurler instead of upstream. The skewable roll could be placed before the decurler or even the bowed roll. As stated, all roll and decurler bar or roll movements could be controlled by mechanical linkage, hydraulic, pneumatic or electrical means or combinations of and by computer control/software. The various upstream and downstream roll locations may vary per process or installation requirements. All of these above modifications in structure and steps and others which are the equivalent thereof, fall within the scope of the appended claims.

What is claimed is:

1. A method for decurling a precurled paper web using a lead in roll, a bowed roll and a decurler comprising the steps of:

leading the precurled web onto the lead in roll, transferring the web from the lead in roll to the bowed roll, moving the lead in roll so that the paper web maintains a consistent wrap on the bowed roll when the decurler is pressed into the web, operating the bowed roll to at least temporarily reduce or eliminate baggyness in the web, as needed, transferring the web from the bowed roll to the decurler, pressing the decurler into the paper web in a direction opposite the precurl initially in the web a sufficient distance to neutralize the precurl, pivoting the decurler and lead in roll in common with each other about the bowed roll, and leading the web from the decurler, whereby the precurled web may be decurled.

2. The method of claim 1, wherein said bowed roll has a high point, aiming the high point of the bowed roll in one of a direction: perpendicular (90°) to a line that bisects the wrap angle of the web on the bowed roll, at an acute angle (less than 90°) for tightening the center of the web, and at an obtuse angle (greater than 90°) for tightening the edges of the web.

3. The method of claim 1, including the step of providing a bow of from about 0.75 inches.

4. The method of claim 1, including providing a bow of from about 0.75 inches to about 2.00 inches.

5. An apparatus for decurling a paper web, comprising a lead in roll for leading the precurled web through the apparatus, a bowed roll downstream of the lead in roll, the lead in roll moving to permit the precurled web to maintain a consistent wrap on the bowed roll, the bowed roll being operable to at least temporarily reduce or eliminate baggyness in the precurled web, carriage means for carrying the bowed roll, said bowed roll being mounted to said carriage means, a decurler downstream of the bowed roll, the decurler being movable into the precurled web in a direction to remove the precurl from the web, whereby the precurl in the web may be removed from the web with consistency in a cross machine direction.

6. An apparatus as in claim 5, comprising a means for moving the bow of said bowed roll relative to said precurled web.

7. An apparatus as in claim 6, wherein said means for moving said bowed roll is powered and may be activated to move from a location remote from said bowed roll.

8. An apparatus for decurling a paper web, comprising a lead in roll for leading the precurled web through the apparatus, a bowed roll downstream of the lead in roll, the lead in roll pivoting to permit the precurled web to maintain a consistent wrap on the bowed roll, the bowed roll being operable to at least temporarily reduce or eliminate baggyness in the precurled web, a decurler downstream of the bowed roll, the decurler being movable into the precurled web in a direction to remove the precurl from the web, carriage means for rotatably mounting said bowed roll, and pivoting means for carrying the decurler to pivot about the bowed roll, said pivoting means being mounted on said carriage means and pivoting about said bowed roll, said decurler pivoting about said bowed roll, whereby the precurl in the web may be removed from the web with consistency in a cross machine direction.

9. An apparatus for decurling a paper web, comprising a lead in roll for leading the precurled web through the apparatus, a bowed roll downstream of the lead in roll, the lead in roll pivoting to permit the precurled web to maintain a consistent wrap on the bowed roll, the bowed roll being operable to at least temporarily reduce or eliminate baggyness in the precurled web, a decurler downstream of the bowed roll, the decurler being movable into the precurled web in a direction to remove the precurl from the web, said decurler pivoting about said bowed roll, carriage means for carrying the bowed roll, said bowed roll being mounted to said carriage means, power means for moving the bow of said bowed roll relative to said precurled web, said power means can be activated to move from a location remote from said bowed roll, pivoting means for carrying the lead in roll to pivot about the bowed roll, said pivoting means carrying the decurler to pivot about the bowed roll, said lead in roll and decurler being mounted on opposite sides of said bowed roll, said pivoting means being mounted on said carriage means and pivoting about said bowed roll, whereby the precurl in the web may be removed from the web with consistency in a cross machine direction.

10. An apparatus for decurling a paper web, comprising a lead in roll for leading the precurled web through the apparatus, a bowed roll downstream of the lead in roll, the lead in roll pivoting to permit the precurled web to maintain a consistent wrap on the bowed roll, the bowed roll being operable to at least temporarily reduce or eliminate baggyness in the precurled web, a decurler downstream of the bowed roll, the decurler being movable into the precurled web in a direction to remove the precurl from the web, said decurler pivoting about the bowed roll to help maintain a consistent wrap of web on the bowed roll, carriage means rotatably mounting said bowed roll, said bowed roll being rotatably mounted to said carriage means, power means for moving the bow of said bowed roll relative to said precurled web, said power means can be activated to move from a location remote from said bowed roll, pivoting means for carrying the lead in roll to pivot about the bowed roll, said pivoting means carrying the decurler to pivot about the bowed roll, said lead in roll and decurler being mounted on opposite sides of said bowed roll, said pivoting means being mounted on said carriage means and pivoting about said bowed roll.

* * * * *

UNITED STATES PATENT AND TRADEMARK OFFICE

CERTIFICATE OF CORRECTION

PATENT NO. : 6,666,809 B1
DATED : December 23, 2003
INVENTOR(S) : John H. Koch

It is certified that error appears in the above-identified patent and that said Letters Patent is hereby corrected as shown below:

Title page,
Item [12], Title, "John" should be -- Koch --
Item [75], Inventor, "Koch H. John" should be -- John H. Koch --

Signed and Sealed this

Fourth Day of May, 2004

JON W. DUDAS
*Acting Director of the United States Patent and Trademark Office*